US006995123B2

(12) United States Patent
Ketelson et al.

(10) Patent No.: US 6,995,123 B2
(45) Date of Patent: Feb. 7, 2006

(54) USE OF MULTIFUNCTIONAL SURFACE ACTIVE AGENTS TO CLEAN CONTACT LENSES

(75) Inventors: Howard Allen Ketelson, Fort Worth, TX (US); David L. Meadows, Colleyville, TX (US); Bor-Shyue Hong, Arlington, TX (US)

(73) Assignee: Alcon, Inc., Hunenberg (CH)

( * ) Notice: Subject to any disclaimer, the term of this patent is extended or adjusted under 35 U.S.C. 154(b) by 0 days.

(21) Appl. No.: 10/738,202

(22) Filed: Dec. 17, 2003

(65) Prior Publication Data

US 2004/0127372 A1 Jul. 1, 2004

Related U.S. Application Data

(60) Provisional application No. 60/436,163, filed on Dec. 23, 2002.

(51) Int. Cl.

| | |
|---|---|
| ***C11D 3/26*** | (2006.01) |
| ***C11D 3/30*** | (2006.01) |
| ***C11D 3/32*** | (2006.01) |
| ***C11D 3/48*** | (2006.01) |

(52) U.S. Cl. ..... 510/112; 510/490; 510/499; 510/477; 510/501; 514/912; 424/78.04

(58) Field of Classification Search ..... 510/112, 510/499, 501, 477, 490; 514/912; 424/78.04
See application file for complete search history.

(56) References Cited

U.S. PATENT DOCUMENTS

| | | | | |
|---|---|---|---|---|
| 3,908,680 | A | | 9/1975 | Krezanoski |
| 4,013,576 | A | | 3/1977 | Loshack |
| 4,046,706 | A | | 9/1977 | Krezanoski |
| 4,410,442 | A | | 10/1983 | Lucas et al. |
| 4,738,790 | A | | 4/1988 | Miyajima et al. |
| 4,908,147 | A | | 3/1990 | Tsao et al. |
| 5,177,243 | A | | 1/1993 | Parker |
| 5,191,081 | A | | 3/1993 | Parker |
| 5,191,106 | A | | 3/1993 | Parker |
| 5,250,728 | A | | 10/1993 | Parker et al. |
| 5,284,972 | A | | 2/1994 | Parker et al. |
| 5,298,182 | A | | 3/1994 | Tsao et al. |
| 5,405,878 | A | * | 4/1995 | Ellis et al. ..... 422/28 |
| 5,536,452 | A | | 7/1996 | Black |
| 5,631,005 | A | | 5/1997 | Dassanayake et al. |
| 5,728,733 | A | | 3/1998 | Ptchelintsev |
| 5,801,139 | A | | 9/1998 | Fair et al. |
| 5,817,277 | A | | 10/1998 | Mowrey-McKee |
| 5,821,215 | A | | 10/1998 | Crudden et al. |
| 5,846,919 | A | | 12/1998 | Tsao et al. |
| 5,858,937 | A | | 1/1999 | Richard et al. |
| 5,869,441 | A | | 2/1999 | Fair et al. |
| 5,962,717 | A | | 10/1999 | Nonomura et al. |
| 6,057,277 | A | | 5/2000 | Crudden et al. |
| 6,214,596 | B1 | * | 4/2001 | Asgharian et al. ..... 435/188 |
| 6,242,411 | B1 | | 6/2001 | D'Ambrogio et al. |
| 6,319,464 | B1 | | 11/2001 | Asgharian |
| 6,432,893 | B1 | * | 8/2002 | Doi et al. ..... 510/112 |
| 6,503,873 | B1 | | 1/2003 | Crudden et al. |
| 6,664,294 | B1 | | 12/2003 | Park et al. |
| 2002/0028754 | A1 | | 3/2002 | Johansen et al. |
| 2004/0034042 | A1 | | 2/2004 | Tsuji et al. |

FOREIGN PATENT DOCUMENTS

| | | |
|---|---|---|
| EP | 0 976 392 | 2/2000 |
| WO | WO 92/05234 | 4/1992 |
| WO | WO 99/19449 | 4/1999 |

OTHER PUBLICATIONS

Crudden, et al., "N-ACYL ED3A Chelating Surfactants: Toxicology and Irritancy", 4th *World Surfactants Congress*, Barcelona, vol. 2 (1996), pp. 52-66.
Crudden, et al., "The Properties and Applications of N-ACYL ED3A Chelating Surfactants", 4th *World Surfactants Congress*, Barcelona, vol. 2, (1996), pp. 139-158.

* cited by examiner

*Primary Examiner*—Gregory R. Del Cotto
(74) *Attorney, Agent, or Firm*—Gregg C. Brown

(57) ABSTRACT

Cleaning compositions for contact lenses are described. The compositions contain multifunctional anionic surfactants that include at least two hydrophilic dissociating head groups. The multifunctional surfactants described (e.g., LED3A) possess both surface active and chelating properties, and have been found to be particularly effective in removing protein deposits from contact lenses.

24 Claims, No Drawings

USE OF MULTIFUNCTIONAL SURFACE ACTIVE AGENTS TO CLEAN CONTACT LENSES

CLAIM FOR PRIORITY

This application claims priority under 35 USC 119(e) from U.S. Ser. No. 60/436,163, filed Dec. 23, 2002.

BACKGROUND OF THE INVENTION

The present invention relates to aqueous compositions for cleaning contact lenses, particularly soft contact lenses.

Deposits such as proteins, lipids and calcium are formed on contact lenses when these lenses are worn on the eye. Proteins adsorb to almost all surfaces and the minimization or elimination of protein adsorption has been the subject of numerous studies and technologies. The removal of proteins from a contact lens is required due to the irritation and discomfort that result from the buildup of deposits on the surface of the lens.

Various compositions and methods have been utilized to clean contact lenses prior to the present invention. The prior compositions and methods have included cleaning agents such as surfactants, chelating agents and proteolytic enzymes. The present invention is particularly directed to the removal of protein deposits from contact lenses. The principal component of such deposits is lysozyme.

Lysozyme is one of the major proteinaceous components in human tears. It is an enzyme that acts as an antimicrobial agent by degrading glycosidic linkages between N-acetylmuramic acid and N-acetylglucosamine units of the microbial cell wall. Thus, the presence of lysozyme in human tears is a natural defense mechanism against ocular infections. Unfortunately, when contact lenses are placed on the eye, prolonged bathing of the lenses by the tears leads to deposits of lysozyme on the lenses. Lysozyme is a protein, and the deposits of lysozyme on contact lenses are typically composed of a mixture of proteins, lipids and other materials. These deposits become bound to the lenses, and consequently are very difficult to remove.

The use of proteolytic enzymes (e.g., pancreatin) to remove protein deposits from contact lenses has been fairly effective. However, the treatment of contact lenses with cleaning compositions containing proteolytic enzymes is considered by some contact lens wearers to be undesirable, in view of cost, convenience and other factors. Consequently, the use of proteolytic enzyme products to remove protein deposits from contact lenses has declined greatly over the past decade. The enzyme products have largely been replaced by complexing agents contained in "multi-purpose" solutions that are used to clean and disinfect contact lenses on a daily basis. For example, U.S. Pat. No. 5,858,937 (Richard, et al.) describes the use of phosphonates in multi-purpose solutions to remove protein deposits. Although multi-purpose solutions containing such complexing agents have been commercially successful, there is a need for improved solutions, particularly solutions that are more effective in preventing and removing protein deposits. The present invention addresses this need.

SUMMARY OF THE INVENTION

The present invention is based on the finding that certain types of anionic surfactants are particularly useful in removing deposits from contact lenses. The anionic surfactants utilized in the present invention have both surface active and chelating properties, and are therefore referred to as being "multifunctional".

The combination of hydrophobic and sequestering properties makes the multifunctional anionic surfactants described herein particularly effective for removing insoluble proteinaceous material, inorganic calcium salts and lipids from contact lenses.

It has been discovered that even at low levels, the multifunctional agents described herein provide superior cleaning properties relative to common surfactants and chelating agents (e.g., non-ionic block copolymer surfactants, such as the poloxamines sold under the trade name "Tetronic®" and the poloxamers sold under the trade name "Pluronic®, and chelating agents, such as EDTA, 1-hydroxyethylidene-1,1-diphosphonic acid, and sodium citrate). In addition, the multifunctional agents preferably have sufficient hydrophobicity to confer anti-microbial properties to the molecule.

The multifunctional cleaning agents described herein may be contained in various types of compositions for treating contact lenses, such as wetting solutions, soaking solutions, cleaning solutions, comfort solutions, and multi-purpose solutions. The primary function of the multifunctional anionic surfactants in the compositions of the present invention is to facilitate cleaning of contact lenses, but these agents may also serve to enhance the antimicrobial activity of the compositions, prevent or reduce the uptake of biocides by the lenses, and improve the wettability of the lenses. The enhanced antimicrobial activity may be useful in preventing microbial contamination of the compositions described herein (i.e., an antimicrobial preservative function), or to kill microorganisms found on contact lenses (i.e., a disinfection function).

The advantages of the multifunctional agents include superior chelation properties, effectiveness at low concentrations, an ability to remove all types of lens deposits (protein, calcium and lipid), and compatibility with the disinfection properties of the formulation.

DETAILED DESCRIPTION OF INVENTION

The multifunctional agents utilized in the present invention are anionic dissociating compounds that contain hydrophilic dissociating head groups. The head groups must be capable of dissociating at physiological pH levels. The compounds have a hydrocarbon chain length of C8 to C18. The anionic groups can be derived from acids, such as carboxylic, sulfonic or phosphonic. Examples of structures for multifunctional agents bearing acetate groups include:

(1) amphoglycinates of the following formula:

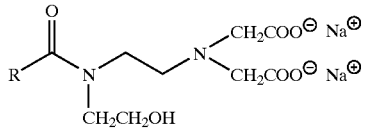

(I)

wherein R is a straight or branched alkyl or alkenyl group containing a total of from 8 to 18 carbon atoms;

(2) alkyl iminodiacetates of the following formula:

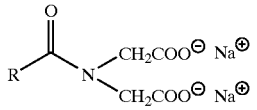

(II)

wherein R is a hydrocarbon group, as defined above;

(3) alkyl glutamates of the following formula:

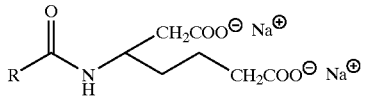

(III)

wherein R is a hydrocarbon group, as defined above; and (4) ethylene diaminetriacetates of the following formula:

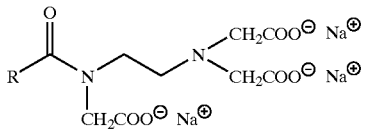

(IV)

wherein R is a hydrocarbon group, as defined above.

The preferred multifunctional agents are those wherein R is an alkyl group containing nine or ten carbon atoms ("C9 or C10").

The most preferred class of multifunctional agents are the ethylene diaminetriacetates of formula (IV), above. These agents are referred to herein by the term "ED3A". The most preferred ethylene diaminetriacetate is lauroyl ethylene diaminetriacetate (also known as "LED3A"), which has the following formula:

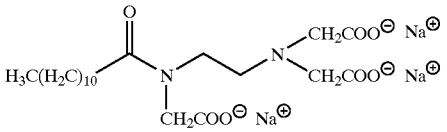

LED3A - lauroylethylenediaminetriacetate,
Physiological pH - Anionic

The multifunctional agents of formulas (I)–(IV) above are known and are commercially available. For example, the ethylene diaminetriacetate LED3A is available from Hampshire Chemical Corporation under the name "Hampshire LED3A", and the alkyl iminodiacetates disodium cocoamphodiacetate and disodium lauroamphodiacetate are available from Goldschmidt Chemical Corporation under the trade names "REWOTERIC® AM2C NM" (referred to below by means of the term "REW AM2C") and REWOTERIC® AM2L, respectively.

The following publications may be referred to for further details regarding the properties and uses of the above-described ED3A multifunctional agents:

Crudden, J. J., Parker, B. A., Lazzaro, J. V., "The Properties and Applications of N-Acyl ED3A Chelating Surfactants", 4$^{th}$ *World Surfactant Congress*, Barcelona, pages 139–158 (1996);

Crudden, J. J., Parker, B. A., "The Irritancy and Toxicology of N-Acyl ED3A Chelating Surfactants", 4$^{th}$ *World Surfactant Congress*, Barcelona, pages 52–66 (1996);

U.S. Pat. No. 5,177,243;

U.S. Pat. No. 5,191,081;

U.S. Pat. No. 5,191,106;

U.S. Pat. No. 5,250,728;

U.S. Pat. No. 5,284,972; and

U.S. Pat. No. 6,057,277.

The entire contents of the above-cited publications pertaining to the structure and physical properties of ED3A multifunctional agents are hereby incorporated in the present specification by reference.

The amount of multifunctional agent contained in the compositions of the present invention will depend on the particular agent selected, the type of formulation in which the agent is contained, and the function or functions to be performed by the agents (i.e., cleaning, enhancement of antimicrobial activity and/or prevention of biocide uptake by contact lenses), and other factors that will be apparent to persons skilled in the art. The amount of multifunctional agent required to achieve cleaning of contact lenses is referred to herein as a "an amount effective to clean". The amount of multifunctional agent required to enhance antimicrobial activity is referred to as "an amount effective to enhance antimicrobial activity". The amount of multifunctional agent required to prevent uptake of biocides by contact lenses is referred to as "an amount effective to prevent biocide uptake". The compositions of the present invention will typically contain one or more multifunctional agents at a concentration in the range of 0.001 to about 1 weight/volume percent ("w/v %"), preferably about 0.05 to 0.5 w/v %, and more preferably between 0.1 to 0.2 w/v %.

The multifunctional agents of the present invention may also be combined with other components commonly utilized in products for treating contact lenses, such as rheology modifiers, enzymes, antimicrobial agents, surfactants, chelating agents or combinations thereof. The preferred surfactants include anionic surfactants, such as RLM 100, or nonionic surfactants, such as poloxamines and poloxamers. Furthermore, a variety of buffering agents may be added, such as sodium borate, boric acid, sodium citrate, citric acid, sodium bicarbonate, phosphate buffers and combinations thereof.

The pH of the solutions should be preferably about 7.0–8.0. Although sodium hydroxide can be used to increase the pH of the formulations, other bases such as 2-amino-2-methyl-1-propanol ("AMP"), triethanolamine, 2-amino-butanol and Tris(hydroxymethyl) aminomethane may also be used. As will be appreciated by persons skilled in the art, the micellar and other surface active properties of ionic surfactants are dependant on various factors, such as the degree of binding of the counterion, and consequently the type of base used can be important. Counterion properties such as valence, polarizability and hydrophobicity are factors requiring consideration when choosing bases to adjust the pH of surfactants to physiological conditions.

The ophthalmic compositions of the present invention may contain one or more ophthalmically acceptable antimicrobial agents in an amount effective to prevent microbial contamination of the compositions (referred to herein as "an amount effective to preserve"), or in an amount effective to disinfect contact lenses by substantially reducing the number of viable microorganisms present on the lenses (referred to herein as "an amount effective to disinfect").

The levels of antimicrobial activity required to preserve ophthalmic compositions from microbial contamination or to disinfect contact lenses are well known to those skilled in the art, based both on personal experience and official, published standards, such as those set forth in the United States Pharmacopoeia ("USP") and similar publications in other countries.

The invention is not limited relative to the types of antimicrobial agents that may be utilized. The preferred biocides include: chlorhexidine, polyhexamethylene biguanide polymers ("PHMB"), polyquaternium-1, and the amino biguanides described in co-pending U.S. patent application Ser. No. 09/581,952 and corresponding International (PCT) Publication No. WO 99/32158, the entire contents of which are hereby incorporated in the present specification by reference.

Amidoamines and amino alcohols may also be utilized to enhance the antimicrobial activity of the compositions described herein. The preferred amidoamines are myristamidopropyl dimethylamine ("MAPDA") and related compounds described in U.S. Pat. No. 5,631,005 (Dassanayake, et al.). The preferred amino alcohols are 2-amino-2-methyl-1-propanol ("AMP") and other amino alcohols described in U.S. Pat. No. 6,319,464. The entire contents of the '005 and '464 patents are hereby incorporated in the present specification by reference.

The most preferred amino biguanide is identified in U.S. patent application Ser. No. 09/581,952 as "Compound Number 1". This compound has the following structure:

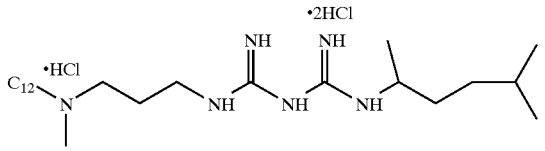

It is referred to below by means of the code number "AL-8496".

The most preferred antimicrobial agents for use in multipurpose solutions for treating contact lenses are polyquaternium-1 and MAPDA.

The ophthalmic compositions of the present invention will generally be formulated as sterile aqueous solutions. The compositions must be formulated so as to be compatible with ophthalmic tissues and contact lens materials. The compositions will generally have an osmolality of from about 200 to about 400 milliosmoles/kilogram water ("mOsm/kg") and a physiologically compatible pH.

The cleaning of proteins from surfaces has previously been accomplished via various chemical compositions (e.g., surfactants, chelating agents, and enzymes). Although not wishing to be bound by any theory, it is believed that the superior cleaning efficacy of the multifunctional anionic surfactants described herein is the result of a combination of self-chelating and hydrophobic properties.

The compositions of the present invention and the ability of these compositions to clean contact lenses are further illustrated in the following examples.

EXAMPLE 1

The formulations shown in Table 1 below were tested to evaluate the ability of the multifunctional surfactants described above to remove protein deposits (i.e., lysozyme) from Group IV lenses. The cleaning performance was compared to conventional cleaning agents. The test procedures are described below, and the cleaning results are set forth at the bottom of Table 1.

Materials/Methods

The materials and methods utilized in the evaluation were as follows:

Phosphate Buffered Saline ("PBS")

The materials and methods utilized in the evaluation were as follows: 1.311 g of monobasic sodium phosphate (monohydrate), 5.74 g of dibasic sodium phosphate (anhydrous), and 9.0 g of sodium chloride were dissolved in deionized water and the volume was brought to 1000 mL with deionized water after completely dissolving the solutes and adjusting pH (if needed). The final concentrations of sodium phosphate and sodium chloride were 0.05 M and 0.9 w/v %, respectively. The final pH was 7.4.

Lysozyme Solution

A 1.0-mg/mL lysozyme solution was prepared by dissolving 500 mg of lysozyme in 500-mL of phosphate buffered saline.

Lens Extraction Solution (ACN/TFA)

A lens extraction solution was prepared by mixing 1.0 mL of trifluoroacetic acid with 500-mL of acetonitrile and 500 mL of deionized water. The pH of the solution ranged from 1.5 to 2.0.

Lens Deposition Procedure (Physiological Deposition Model)

Each lens was immersed with 5 mL of lysozyme solution in a Wheaton glass sample vial. The vial was closed with a plastic snap cap and incubated in a constant temperature water bath at 37° C. for 24 hours. After incubation, the deposited lens was removed from the vial and rinsed by dipping into three consecutive beakers containing 50 mL of deionized water to remove any excess of the deposition solution. The lens was then blotted gently with a laboratory towel (Kaydry EX-L, from Kimberly-Clark). These lenses were used as a soiled lenses for the evaluation of cleaning efficacy of the test solutions.

Lens Deposition Procedure (Physiological/Thermal Combination Model)

The lens was immersed in a Wheaton glass sample vial containing 5 mL of UNISOL® 4 saline solution. The vial was closed with a plastic snap cap held secure with a metal clasp to prevent the cap from popping off during the thermal treatment. The vial was then heated in a professional contact lens aseptor at 90° C. for 15 minutes. After cooling down to room temperature, the lens was removed from the vial and rinsed by dipping one time into a 50 mL fresh UNISOL® 4 solution and blotted gently with a laboratory towel (Kaydry EX-L). These lenses were adopted as the soiled lenses of physiological/thermal combination model for the cleaning efficacy evaluation.

Cleaning Procedure

Each soiled lens was soaked and shaken with 5 mL of the test solution in a scintillation vial at room temperature for 12 hours. After the soaking period, the lenses were removed from their respective test solutions and rinsed by dipping into three consecutive beakers containing 20 mL of UNISOL® 4 solution. No mechanical rubbing was applied to the cleaning regimen. The clean lenses were then subjected to the extraction procedure described below, and the amount of lysozyme present in the soaking solutions was measured with a fluorescence spectrophotometer.

Extraction and Determination of Lysozyme Extraction

The clean lenses were extracted with 5 ml of ACN/TFA extraction solution in a screw-capped glass scintillation vial. The extraction was conducted by shaking the vial with a rotary shaker (Red Rotor) at room temperature for at least 2 hours (usually overnight).

Determination of Lysozyme

A quantitative determination of the amount of lysozyme in the lens extract solution and lens soaking solutions was carried out by a fluorescence spectrophotometer interfaced with an autosampler and a computer. The fluorescence intensity of a 2 mL aliquot from each sample solution was measured by setting the excitation/emission wavelength at 280 nm/346 nm with excitation/emission slits of 2.5 nm/10 nm, respectively, and the sensitivity of the photomultiplier was set at 950 volts.

A lysozyme standard curve was established by diluting the lysozyme stock solution to concentrations ranging from 0 to 60 μg/ml with either ACN/TFA solution or OPTI-FREE® Rinsing, Disinfecting and Storage Solution (Alcon Laboratories, Inc.) and measuring the fluorescence intensity using the same instrumental settings as those used for the lens extracts and lens soaking solutions. The lysozyme concentrations for all the samples were calculated based on the slope developed from the linear lysozyme standard curve.

Cleaning Efficacy

The percent cleaning efficacy of the test solutions was calculated by dividing the amount of lysozyme present in the soaking solution by the sum of the amounts present in the lens extract solution and the soaking solution, and multiplying the resulting quotient by 100.

The cleaning efficacy of the formulations described in Table 1 below was evaluated based on the above-described procedures. Table 1 shows the cleaning efficacy results using a sorbitol/boric acid/sodium chloride buffer vehicle. The cleaning efficacy of the control vehicle (formulation E) was 14.3%, whereas the cleaning efficacies of solutions containing the multifunctional agents described herein ranged from 39.4% to 67.1%.

TABLE 1

Demonstration of Cleaning Efficacy

| | Concentration (% w/v) | | | | |
|---|---|---|---|---|---|
| Component | A | B | C | D | E |
| Polyquaternium-1 | — | — | 0.0011% | — | 0.0011% |
| REW AM2C | — | — | — | 0.5 | — |
| LED3A | 0.1 | 0.2 | 0.5 | — | — |
| Sorbitol | 1.5 | 1.5 | 1.5 | 1.5 | 1.5 |
| Boric Acid | 0.6 | 0.6 | 0.6 | 0.6 | 0.6 |
| Sodium chloride | 0.32 | 0.32 | 0.32 | 0.32 | 0.32 |
| Water | Qs 100% | Qs 100% | Qs 100% | Qs 100% | Qs 100% |
| Osmolality (mOsm $kg^{-1}$) | — | — | 275 | — | — |
| pH | 7.5 | 7.5 | 7.5 | 7.5 | 7.5 |
| % Cleaning efficacy | 39.4 +/− 0.7 | 67.1 +/− 1.5 | 66.4 +/− 2.2 | 52.3 +/− 0.7 | 14.3 +/− 0.4 |

EXAMPLE 2

A second in vitro cleaning study was conducted to further evaluate the cleaning efficacies of the compositions of the present invention. The test procedures were the same as described in Example 1. Table 2 below shows the formulations that were evaluated and the results obtained:

TABLE 2

Comparison of cleaning formulations of the present invention and buffer vehicle controls.

| | Concentration (% w/v) | | | | | | |
|---|---|---|---|---|---|---|---|
| Component | A | B | C | D | E | F | G |
| Lauryl iminodiacetate | — | | 0.2 | — | — | — | — |
| Lauryl glutamate | — | — | — | 0.2 | 0.5 | — | — |
| REW AM2C | — | — | — | — | — | — | 0.5 |
| REW AMC | — | — | — | — | — | 0.5 | — |
| Sorbitol | 1.5 | 1.5 | 1.5 | 1.5 | 1.5 | 1.5 | 1.5 |

TABLE 2-continued

| Comparison of cleaning formulations of the present invention and buffer vehicle controls. | | | | | | | |
|---|---|---|---|---|---|---|---|
| | Concentration (% w/v) | | | | | | |
| Component | A | B | C | D | E | F | G |
| Boric Acid | 0.6 | 0.6 | 0.6 | 0.6 | 0.6 | 0.6 | 0.6 |
| Sodium chloride | 0.32 | 0.32 | 0.32 | 0.32 | 0.3 | 0.32 | 0.32 |
| Disodium EDTA | — | 0.2 | — | — | — | — | — |
| Water | Qs 100% | Qs 100% | Qs 100% | Qs 100% | Qs 100% | Qs 100% | Qs 100% |
| pH | 7.5 | 7.5 | 7.5 | 7.5 | 7.5 | 7.5 | 7.5 |
| % Cleaning efficacy | 7.6 ± 0.1 | 19.4 +/− 0.9 | 30.3 +/− 1.8 | 28.4 +/− 1.0 | 77.2 +/− 2.2 | 15.4 +/− 0.6 | 52.3 +/− 0.7 |

Formulation A was utilized as a control solution. It contained the sorbitol/boric acid/sodium chloride vehicle utilized in all of the compositions tested, but without any cleaning agent. The percent cleaning efficacy ("% CE") of formulation A was 7.6%. Formulation B was utilized as a second control solution. It was identical to formulation A, except for the addition of EDTA at a concentration of 0.2 w/v %.

EDTA is widely used in contact lens care products. The multifunctional surfactant LED3A is similar to EDTA, except for the substitution of the acetic acid group for an acyl group (i.e., a $C_{12}$ chain in the case of LED3A). A comparison of the results obtained with the EDTA solution (i.e., formulation B) to the results obtained with the LED3A solutions (see Table 1—Formulations A and B) shows that the cleaning efficacy using EDTA at a concentration of 0.2% was 19.4%, while the cleaning efficacies of the LED3A solutions at concentrations of 0.1 and 0.2% were 39.4% and 67.1%, respectively.

A comparison of a second pair of solutions was carried out to evaluate the importance of the number of carboxyl groups present on the head group of the multifunctional surfactants utilized in the present invention. Formulation G (Table 2) contained one of the preferred surfactants of the present invention, REWAM2C, while formulation F (Table 2) contained a related surfactant that does not fall within the scope of the present invention, (i.e., REW AMC).

REW AMC has a similar structure to REW AM2C, except that one of its carboxymethyl groups is replaced with a proton (bonded to the nitrogen atom). The results in Table 2 show that cleaning efficacy increased from 15.4% (formulation F) to 52.3% (formulation G) when the number of carboxymethyl groups on the head group increased from one to two. These results demonstrate the importance of having at least 2 anionic groups.

Two other multi-functional surfactants, lauryl iminodiacetate (formulation C—Table 2) and lauryl glutamate (formulations D and E—Table 2) were also evaluated for their cleaning efficacy properties due to the presence of diacetate headgroups. The cleaning efficacies for formulations C, D and E were 30.3%, 28.4% and 77.2%, respectively. These results show that the multifunctional surfactants significantly improved cleaning efficacy (i.e., relative to the control, formulation A).

EXAMPLE 3

An in vitro cleaning study was also conducted to evaluate the cleaning efficacy of compositions wherein the multifunctional surfactant LED3A was combined with sodium citrate, in the absence of sodium chloride. The formulations tested and the cleaning data are provided in Table 3 below:

TABLE 3

| | Concentration (% w/v) | | | | |
|---|---|---|---|---|---|
| Component | 9819-44C | 9819-44D | 9819-44E | 9819-44G | Control Vehicle |
| LED3A | 0.03% | 0.075 | 0.1 | 0.2 | — |
| Sorbitol | 0.4% | 0.4% | 0.4% | 0.4% | 0.4% |
| Sodium Borate | 0.2% | 0.2% | 0.2% | 0.2% | 0.2% |
| Sodium Citrate | 0.6% | 0.6% | 0.6% | 0.6% | 0.6% |
| Propylene Glycol | 1.0% | 1.0% | 1.0% | 1.0% | 1.0% |
| Disodium EDTA | 0.05 | 0.05 | 0.05 | 0.05 | 0.05 |
| Water | Qs 100% | Qs 100% | Qs 100% | Qs 100% | Qs 100% |
| pH | 7.8 | 7.8 | 7.8 | 7.8 | 7.8 |
| % Cleaning efficacy | 29.5 | 47.5 | 56.0 | 60.2 | 22 |

The data in Table 3 show the dose response of adding LED3A to a borate buffered vehicle containing 0.6% sodium citrate. The vehicle containing citrate without LED3A has a cleaning efficacy of 22%. The addition of LED3A at concentrations of 0.03 and 0.075% increased the cleaning efficacy of the formulations to 29.5% and 47.5%, respectively. Increasing the concentration of the LED3A to 0.1% and 0.2% further enhanced the cleaning levels to 56.0 and 60.2%, respectively.

EXAMPLE 4

An in vitro cleaning study was also conducted to evaluate the cleaning efficacy of preferred ED3A multi-functional agents having C9 and C10 alkyl chain lengths surfactants (i.e., C10-ED3A and C9-ED3A). The surface tensions and cleaning efficacies of solutions containing the agents were evaluated in accordance with the procedures described in Example 1. The results are presented in Table 4, below:

TABLE 4

| Formulation Chemical | Concentration (% w/v) | | |
|---|---|---|---|
| (% wt/% vol) | A | B | C |
| AL-8496* | 0.0004 | 0.0004 | 0.0004 |
| C9-ED3A | — | — | 0.2 |
| C10-ED3A | — | 0.2 | — |
| Sorbitol | 0.4 | 0.4 | 0.4 |
| Sodium Borate | 0.2 | 0.2 | 0.2 |
| Sodium Citrate | 0.6 | 0.6 | 0.6 |
| Propylene Glycol | 1.0 | 1.0 | 1.0 |

TABLE 4-continued

| Formulation Chemical (% wt/% vol) | Concentration (% w/v) A | B | C |
|---|---|---|---|
| Disodium Edetate | 0.05 | 0.05 | 0.05 |
| Purified Water | QS | QS | QS |
| PH | 7.8 | 7.8 | 7.8 |
| % Cleaning Efficacy | 20.8 | 40.1 | 39.8 |
| Surface Tension ($mNm^{-1}$) | — | 53.3 | 60.8 |

*As base

The results show that the solutions containing the multifunctional surfactants C9-ED3A (i.e., formulation C) and C10-ED3A (i.e., formulation B) exhibited a significantly higher cleaning efficacy than the control solution (i.e., formulation A).

EXAMPLE 5

The formulations described in Table 5 below represent examples of the use of multifunctional surfactants such as using C9-ED3A and C10-ED3A in solutions containing the antimicrobial agent Polyquad® (polyquaternium-1). It was determined that the antimicrobial activity of polyquaternium-1 was not compromised by the multifunctional surfactants utilized in the present invention.

TABLE 5

| Component | Concentration (% w/v) 9979-74A | 9979-74B | 9979-74C | 9979-74D | 9979-74E | 9979-74F |
|---|---|---|---|---|---|---|
| Polyquaternium-1 | 0.0002 | 0.0002 | 0.0002 | 0.0002 | 0.0002 | 0.0002 |
| Assay (ppm) | 1.9 | 2.4 | 1.8 | 1.8 | 1.8 | 2.3 |
| Poloxamine 1304 | 0.05 | 0.05 | 0.05 | 0.05 | 0.05 | 0.05 |
| Propylene glycol | 1.0 | 0.8 | 1.0 | 0.6 | 1.0 | 0.8 |
| Sodium chloride | | 0.3 | | 0.3 | | 0.3 |
| Sorbitol | 0.4 | 0.4 | 0.4 | 0.4 | 0.4 | 0.4 |
| Sodium borate | 0.6 | 0.6 | 0.6 | 0.6 | 0.6 | 0.6 |
| $C_9$-ED3A | | | 0.2 | 0.2 | | |
| $C_{10}$-ED3A | | | | | 0.1 | 0.1 |
| PH | 7.8 | 7.8 | 7.8 | 7.8 | 7.8 | 7.8 |

| Microorganism | Time (hrs) | 9979-74A | 9979-74B | 9979-74C | 9979-74D | 9979-74E | 9979-74F |
|---|---|---|---|---|---|---|---|
| *C. albicans* | 6 | 2.3 | 1.7 | 2.4 | 1.5 | 2.2 | 1.4 |
| | 24 | 3.2 | 2.4 | 2.8 | 1.8 | 2.8 | 1.9 |
| *S. marcescens* | 6 | 6.1* | 3.6 | 5.4 | 4.4 | 5.4 | 4.9 |
| | 24 | 6.1 | 6.1 | 6.1 | 5.4 | 6.1 | 6.1 |
| *S. aureus* | 6 | 5.9 | 4.1 | 4.5 | 4.7 | 4.3 | 3.1 |
| | 24 | 5.9 | 5.9 | 5.9 | 5.9 | 4.3 | 5.9 |

*Underlined number indicates no survivors (<10 CFU/mL) recovered

EXAMPLE 6

Lens Uptake Reduction of AL-8496 Using C9-ED3A

Table 6 below shows that the lens uptake after 2 cycles using 4 ppm AL-8496 can be reduced using C9-ED3A. The control solutions (i.e., 9979–65H and 9979–65I) gave lens uptakes of 17.4 μg/Lens and 14.0 μg/Lens, respectively. Increasing the C9-ED3A concentration from 0.1% to 0.2% led to significant lens uptake reductions relative to these controls.

TABLE 6

| Component | Concentration (% w/v) 9979-65B | 9979-65C | 9979-65D | 9979-65H |
|---|---|---|---|---|
| AL-8496* | 0.0004 | 0.0004 | 0.0004 | 0.0004 |
| Analysis | 3.8 | 3.9 | 3.9 | 3.9 |
| C9ED3A | 0.1 | 0.15 | 0.2 | — |
| Boric Acid | — | — | — | — |
| Propylene Glycol | 1.0 | 1.0 | 1.0 | 1.0 |
| Sodium Citrate | 0.6 | 0.6 | 0.6 | 0.6 |
| Sorbitol | 0.4 | 0.4 | 0.4 | 0.4 |
| Sodium Borate | 0.2 | 0.2 | 0.2 | 0.2 |
| Poloxamine 1304 | 0.05 | 0.05 | 0.05 | 0.05 |
| Disodium Edetate | 0.05 | 0.05 | 0.05 | 0.05 |
| Purified Water | QS | QS | QS | QS |
| PH | 7.8 | 7.8 | 7.8 | 7.8 |
| Uptake (Acuvue: 2 cycles) μg/Lens | 13.4 | 11.2 | 10.4 | 17.4 |

*As base

EXAMPLE 7

Lens Uptake Reduction of AL-8496 Using C10-ED3A

Table 7 below shows that the lens uptake after 2 cycles using 4 ppm AL-8496 can be reduced using the multifunctional surfactant C10-ED3A. The control solutions (i.e., 9979–65G and 9979–65H) gave lens uptakes of 13.8 μg/Lens and 13.2 μg/Lens, respectively. Increasing the C10-ED3A concentration from 0.05% to 0.1% led to significant lens uptake reductions relative to these controls.

TABLE 7

| Component | Concentration (% w/v) 9979-67A | 9979-67B | 9979-67C | 9979-67G |
|---|---|---|---|---|
| AL-8496* | 0.0004 | 0.0004 | 0.0004 | 0.0004 |
| C10ED3A | 0.05 | 0.075 | 0.1 | — |
| Propylene Glycol | 1.0 | 1.0 | 1.0 | 1.0 |

TABLE 7-continued

| Component | Concentration (% w/v) | | | |
|---|---|---|---|---|
| | 9979-67A | 9979-67B | 9979-67C | 9979-67G |
| Sodium Citrate | 0.6 | 0.6 | 0.6 | 0.6 |
| Sorbitol | 0.4 | 0.4 | 0.4 | 0.4 |
| Sodium Borate | 0.2 | 0.2 | 0.2 | 0.2 |
| Poloxamine 1304 | 0.05 | 0.05 | 0.05 | 0.05 |
| Disodium Edetate | 0.05 | 0.05 | 0.05 | 0.05 |
| Purified Water | QS | QS | QS | QS |
| pH | 7.8 | 7.8 | 7.8 | 7.8 |
| Uptake (Acuvue: 2 cycles) μg/Lens | 9.4 | 7.8 | 7.0 | 13.8 |

*As base

EXAMPLE 8

The formulation shown in Table 8 below is a further example of a preferred multi-purpose solution for cleaning, rinsing, disinfecting and storing contact lenses:

TABLE 8

| Component | Concentration (% w/v) |
|---|---|
| Polyquaternium-1 | 0.001 |
| MAPDA | 0.0005 |
| C9-ED3A | 0.1 |
| Sorbitol | 1.2 |
| Boric Acid | 0.6 |
| Sodium Citrate | 0.65 |
| Sodium Chloride | 0.1 |
| Poloxamine 1304 | 0.1 |
| EDTA | 0.05 |
| AMP (95%) | 0.45 |
| Purified Water | QS |
| PH | 7.8 |

The above-described solution can be prepared as follows:

1. In an appropriate size-compounding vessel add the following ingredients to the compounding vessel followed by adding 80% of final batch volume of purified water with mixing:

a. Poloxamine 1304 b. Sorbitol c. Sodium Borate d. Boric Acid e. Sodium Citrate f. C9-ED3A g. Sodium Chloride h. AMP (95%)

2. Continue mixing for a minimum of 10 min until the C9-ED3A has dissolved.

3. Pipette in the correct amount of the polyquaternium-1 and MAPDA stock solutions. Adjust to 90% of the final volume with purified water.

4. Check pH and if necessary, adjust pH to 7.80±0.05 with either 6N hydrochloric acid or 6N sodium hydroxide solution and mix (none should be required). Record pH.

5. Add purified water to bring batch to 100% of the volume and mix.

We claim:

1. A method of cleaning a contact lens which comprises soaking the lens in an aqueous solution comprising water and an amount of an anionic dissociating compound effective to clean the lens, said compound having the formula:

(IV)

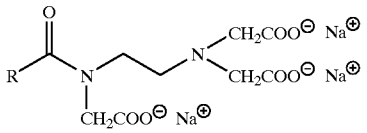

wherein R is a straight or branched alkyl or alkenyl group containing a total of from 8 to 18 carbon atoms.

2. A method according to claim 1, wherein R is an alkyl group containing a total of 9 or 10 carbon atoms.

3. A method according to claim 1, wherein the anionic dissociating compound comprises lauroylethylenediaminetriacetate.

4. A method according to claim 1, wherein said aqueous solution further comprises an ophthalmically acceptable antimicrobial agent in an amount effective to preserve the solution from microbial contamination.

5. A method according to claim 4, wherein said antimicrobial agent comprises polyquaternium-1.

6. A method according to claim 4, wherein said antimicrobial agent comprises a polyhexamethylene biguanide polymer.

7. A method according to claim 1, wherein said aqueous solution further comprises an ophthalmically acceptable antimicrobial agent in an amount effective to disinfect said contact lens, and the lens is soaked in said solution for a time sufficient to clean and disinfect the lens.

8. A method according to claim 7, wherein said antimicrobial agent comprises polyquaternium-1.

9. A method according to claim 7, wherein said antimicrobial agent comprises a polyhexamethylene biguanide polymer.

10. A method according to claim 1, wherein said anionic dissociating compound is present in said aqueous solution at a concentration of 0.001 to 1 w/v %.

11. A method according to claim 1, wherein said aqueous solution is a sterile, multi-purpose solution having a physiologically compatible pH and an osmolality of 200 to 400 mOsm/kg, and said anionic dissociating compound is present in said aqueous solution at a concentration of 0.05 to 0.5 w/v %.

12. A sterile, aqueous multi-purpose solution for treating contact lenses, comprising:

0.001 to 1 w/v % of an anionic dissociating compound of the formula:

(IV)

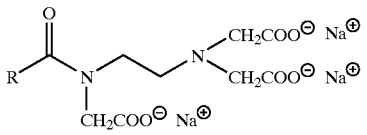

wherein R is a straight or branched alkyl or alkenyl group containing a total of from 8 to 18 carbon atoms;

an ophthalmically acceptable antimicrobial agent in an amount effective to disinfect contact lenses; and water; said solution having a physiologically compatible pH and an osmolality of 200 to 400 mOsm/kg.

13. A multi-purpose solution according to claim 12, wherein R is an alkyl group containing a total of 9 or 10 carbon atoms.

14. A multi-purpose solution according to claim 12, wherein said anionic dissociating compound comprises lauroylethylenediaminetriacetate.

15. A multi-purpose solution according to claim 12, wherein the solution contains said anionic dissociating compound at a concentration of 0.05 to 0.5 w/v %.

16. A multi-purpose solution according to claim 15, wherein the solution contains said anionic dissociating compound at a concentration of 0.1 to 0.2 w/ v%.

17. A multi-purpose solution according to claim 12, wherein said antimicrobial agent comprises polyquaternium-1.

18. A multi-purpose solution according to claim 17, wherein said antimicrobial agent further comprises myristamidopropyl dimethylamine.

19. A multi-purpose solution according to claim 12, wherein the solution further comprises a buffer in an amount sufficient to maintain the pH of the solution in the range of 7.0 to 8.0.

20. A sterile, aqueous, multi-purpose solution for treating contact lenses, comprising: 0.05 to 0.5 w/v % of lauroylethylenediaminetriacetate; an amount of polyquaternium-1 effective to disinfect a contact lens; a buffer in an amount sufficient to maintain the pH of the solution in the range of 7.0 to 8.0; and water; said solution having an osmolality of 200 to 400 mOsm/kg.

21. A multi-purpose solution according to claim 20, wherein the solution contains lauroylethylenediaminetriacetate at a concentration of 0.1 to 0.2 w/v %.

22. A multi-purpose solution according to claim 21, wherein the solution further comprises an amount of myristamidopropyl dimethylamine effective to disinfect the lens.

23. A method of cleaning and disinfecting a contact lens, which comprises: placing the lens in an amount of the solution of claim 12 sufficient to cover the lens, and soaking the lens in said solution for a period of time sufficient to disinfect the lens.

24. A method of cleaning and disinfecting a contact lens, which comprises: placing the lens in an amount of the solution of claim 20 sufficient to cover the lens, and soaking the lens in said solution for a period of time sufficient to disinfect the lens.

* * * * *